United States Patent [19]

DiDonato, Jr. et al.

[11] 4,261,237

[45] Apr. 14, 1981

[54] RIGIDLY SUPPORTED MOLDED PLASTICS MATERIAL PUNCH GUIDE AND STRIPPER

[75] Inventors: Joseph S. DiDonato, Jr., Akron; Timothy J. Kwiecinski, Lakewood, both of N.Y.

[73] Assignee: Houdaille Industries, Inc., Fort Lauderdale, Fla.

[21] Appl. No.: 21,100

[22] Filed: Mar. 16, 1979

Related U.S. Application Data

[62] Division of Ser. No. 823,404, Aug. 10, 1977, Pat. No. 4,166,403.

[51] Int. Cl.[3] ..... B26F 1/14

[52] U.S. Cl. ..... 83/139; 83/140

[58] Field of Search ..... 83/140, 139

[56] References Cited

U.S. PATENT DOCUMENTS

| | | | |
|---|---|---|---|
| 2,168,377 | 8/1939 | Wales | 83/140 |
| 2,562,267 | 7/1951 | Granberg | 83/138 |
| 2,815,814 | 12/1957 | Taylor | 83/139 |
| 2,968,821 | 1/1961 | Morin et al. | 10/72 |
| 2,976,754 | 2/1961 | Wennes | 83/139 |
| 2,983,176 | 5/1961 | Taylor | 83/138 |
| 3,234,835 | 2/1966 | Archbold et al. | 83/139 |
| 3,342,091 | 9/1967 | Schott et al. | 83/140 |
| 3,481,236 | 12/1969 | Nicklasson | 83/140 |
| 3,485,122 | 12/1969 | Achler et al. | 83/139 |
| 3,496,818 | 2/1970 | Porter et al. | 83/140 |
| 3,690,205 | 9/1972 | Brown | 83/139 |
| 3,973,454 | 8/1976 | Eller | 83/55 |
| 3,999,279 | 12/1976 | O'Neal et al. | 29/458 |
| 4,031,787 | 6/1977 | Cady | 83/140 |
| 4,048,890 | 9/1977 | Aeschbach | 83/146 |
| 4,092,888 | 6/1978 | Wilson | 83/140 |

FOREIGN PATENT DOCUMENTS

| | | | |
|---|---|---|---|
| 595529 | 4/1960 | Canada | 83/139 |
| 1778405 | 7/1972 | Fed. Rep. of Germany . | |
| 2310198 | 3/1976 | France . | |
| 2331395 | 10/1977 | France . | |
| 6510647 | 2/1967 | Netherlands . | |
| 1251843 | 11/1971 | United Kingdom . | |

OTHER PUBLICATIONS

Strippit-Houdaille Brochure entitled "Strippit Fabri-Center 1250", copyright 1976 by Houdaille Industries, Inc.

Strippit-Houdaille Catalog entitled "Unitized Punching & Notching Units", copyright 1976 by Houdaille Industries, Inc.

Sonolite Corporation, "The Strippathane System", Temperature Data Sheet dated Feb. 27, 1975 & attached sheets entitled Stripper Shape Selection Chart; Price List; & Strippathane Equipment Description.

*Primary Examiner*—Frank T. Yost

*Attorney, Agent, or Firm*—Hill, Van Santen, Steadman, Chiara & Simpson

[57] ABSTRACT

A punch guide and stripper is molded from plastics material to the exact configuration of the punch and is supported and reinforced by a rigid punch receiving member to engage a workpiece around the slug to be punched therefrom and strip the punch from the workpiece without bulging or damaging the workpiece. The plastics material is molded in situ around the active end or nose of the punch within a rigid metal punch guide at the punch exiting end of the guide to a height or thickness sufficiently to guide and laterally support the nose of the punch throughout its stroke. The surrounding rigid punch guide prevents lateral displacement or distortion of the plastics material and terminates either flush with or just short of the workpiece engaging face of the plastics material. The active end of the punch is of smaller diameter than the main body of the punch and may have any desired configuration with a shoulder extending from the reduced section to the full diameter of the punch. The punch is projected from the surrounding guide beyond the maximum stroke of the punch thereby providing a molding chamber or cavity bounded by the nose or head of the punch, the shoulder, and the surrounding punch guide. A hardenable viscous plastics material is poured into this chamber, cured or otherwise hardened to form the stripper body, the punch is retracted, and the hardened plastics material is ground flush with or just beyond the end edge of the guide to form the workpiece engaging face. An undercut can be provided in the guide to further anchor the stripper body.

8 Claims, 9 Drawing Figures

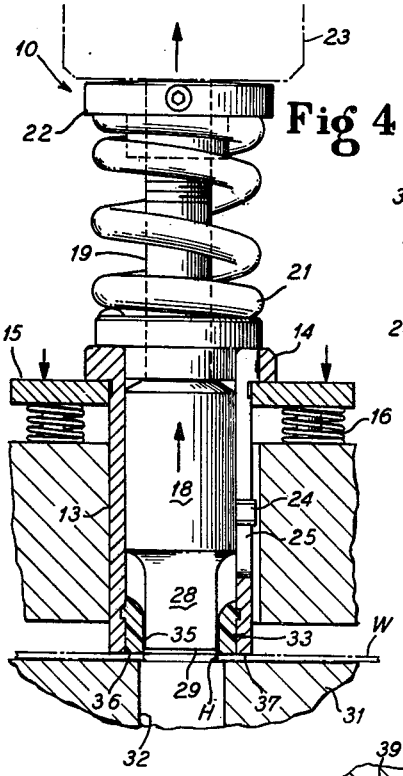
Fig 4
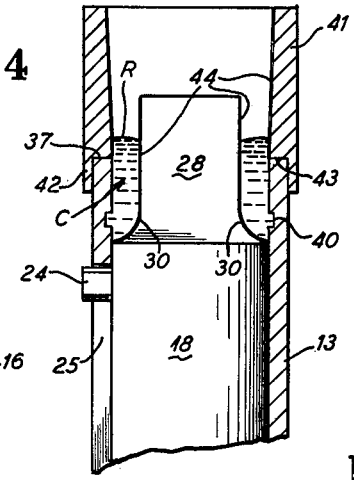
Fig. 7
Fig. 8
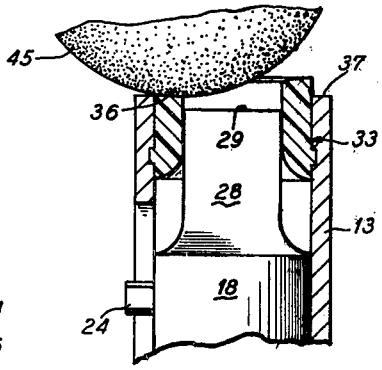
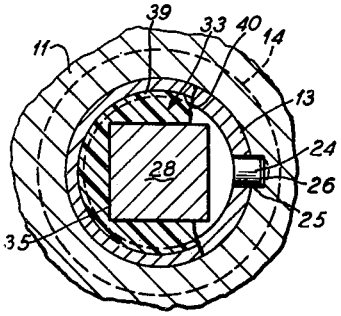
Fig. 5
Fig. 6
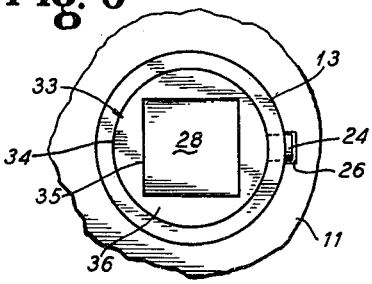
Fig. 9
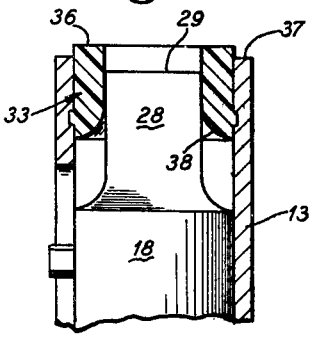

RIGIDLY SUPPORTED MOLDED PLASTICS MATERIAL PUNCH GUIDE AND STRIPPER

This is a division of application Ser. No. 823,404, filed Aug. 10, 1977 now U.S. Pat. No. 4,166,403.

FIELD OF THE INVENTION

This invention relates to the art of guiding punches to workpieces and stripping the punches from the workpieces to prevent damage or distortion of the workpieces. More specifically, this invention deals with a plastics punch stripper and guide molded in situ around the active end of a punch within the exiting mouth of a rigid punch guide to a depth or thickness sufficient to support the punch throughout its stroke and with an end face having an inner periphery conforming exactly with the configuration of the punch to engage the workpiece in the area surrounding the punched out slug and lying flush with the periphery of the punched out hole.

SUMMARY OF THE INVENTION

According to this invention, there is provided a molded plastics material punch guide and stripper reinforced and surrounded by a rigid metal punch receiving member and guide. The stripper and guide is molded or cast in situ around the active end of the punch within the punch exiting mouth of the surrounding punch guide and the cast or molded plastics body has a finished flat end face either flush with or just beyond the exiting end edge of the metal punch guide to engage the workpiece around the margin of the slug to be punched out of the workpiece. Since the punch itself provides the molding surface for the inner periphery of the stripper body, the workpiece engaging end face of the stripper will be flush with the edge of the punched out hole to prevent any dimpling or bulging of the workpiece as the punch is withdrawn from the workpiece.

The plastics material body is surrounded by the rigid metal punch guide in intimate bonded relation therewith and is protected against lateral shifting or distortion so that it will, in turn, accurately guide the punch right up to the point of entry of the punch into the workpiece. The stripper thus cooperates with the punch die to insure accurate and clean-cut punching of the workpiece.

The plastics material is selected for ease in molding, toughness, bearing load and guide capacity, resistance to deformation under stress and impact at the operating temperatures, and capability of being finished to a smooth end face which will not mar the workpiece. The plastics material should be elastomeric to avoid shattering under stress and since it is reinforced by the surrounding rigid metal punch guide, it will not shift. For ease in molding, it can be cast from a viscous hardenable fluid. Both thermoplastic and thermosetting resins are operative.

Urethane-type resins are preferred. The following resins of this type are useful examples:

"K-PRENE"—a urethane elastomer marketed by DiAero, Division of Houdaille Industries, Inc., Lake City, Minnesota, the K-100 grade having the following properties is especially useful:

| | |
|---|---|
| Hardness | 92A |
| Tensile Strength, PSI | 6,100 |
| Elongation, % | 690 |

-continued

| | |
|---|---|
| 100% Modulus, PSI | 1,300 |
| 300% Modulus, PSI | 1,970 |
| Tear, D-470, PLI | 190 |
| Tear, Die C, PLI | 800 |
| Bashore Resilience, % | 55 |
| Compression Set, Method B, 22 hrs. 158° F. | 28 |
| Bell Brittle, °F. | −90 |

"CONAP"—a Poly ether Polyurethane marketed by Conap, Inc., Olean, New York, the UC-22 grade is a liquid which will cure at room or elevated temperatures to provide the following very desired properties:

| | | |
|---|---|---|
| Hardness, Shore D | 70 (68) | ASTM D2240 |
| Tensile Strength, psi | 2900 (2600) | ASTM D412 |
| Elongation, % | 70 (150) | ASTM D412 |
| Tear Strength, pli | 385 (430) | ASTM D624 |

Thermosetting epoxy casting resins capable of hardening from viscous precurable liquids into hard tough solids either at room or elevated temperatures or with hardeners are also useful and a wide selection is available under trade names such as "EPI-BIS" from Dow Chemical Co., "NOVOLAC" from Union Carbide Corp., "EPI-REZ" from Celanese Co. and the like.

When the punch is used as a portion of the mold for the in situ casting of the stripper body it should be coated with a release agent or lubricant.

It is then an object of this invention to provide a combined punch guide and stripper formed of plastics material and reinforced by a surrounding rigid punch receiving member.

Another object of this invention is to improve the quality and accuracy of punching operations by guiding the punch right up to its point of entry into a workpiece in an elastomeric plastics material stripper engaging the workpiece and reinforced against displacement or distortion by a surrounding rigid punch guide tube.

Another object of this invention is to provide a punch stripper molded in situ in a punch guide tube around the active end of the punch.

A specific object of this invention is to cast a punch stripper in the exiting mouth of a punch guide around the active end of the punch.

Other and further objects of this invention will become apparent to those skilled in this art from the following detailed description of the annexed sheets of drawings which, by way of a preferred example only, illustrate an embodiment of the invention.

ON THE DRAWINGS

FIG. 4 is a view similar to FIGS. 1 to 3 but showing the relative positions of the parts upon retraction of the punch from the workpiece;

FIG. 5 is a cross-sectional view along the line V—V of FIG. 1;

FIG. 6 is a bottom plan view taken along the line VI—VI of FIG. 1;

FIG. 7 is a somewhat diagrammatic cross-sectional view, with parts in elevation illustrating the casting or molding of the stripper body around the active end of the punch in the punch guide;

FIG. 8 is a view similar to FIG. 7 but illustrating the grinding of the molded stripper body flush with the bottom end edge of the punch guide;

FIG. 9 is a view similar to FIG. 8 but showing the stripper body projecting slightly beyond the punch guide.

AS SHOWN ON THE DRAWINGS

Figure 1:
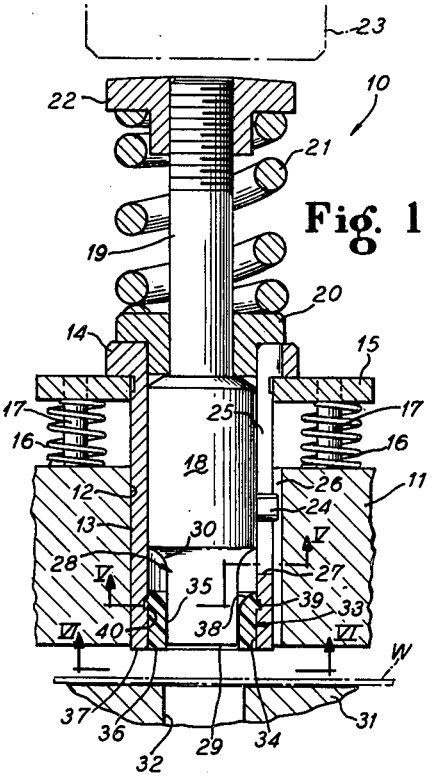
FIG. 1 is a fragmentary cross-sectional view of a turret punch equipped with a stripper and guide according to this invention and showing the relative positions of the parts in retracted position at the start of a punching step.

The assembly 10 of FIGS. 1 to 4 illustrates one station of a turret punch machine having the molded plastics punch stripper and guide of this invention in position in the assembly. The assembly 10 includes a punch holder or turret 11 having a vertical punch receiving hole 12 therethrough. A tubular punch guide 13 is suspended in the hole 12 by an outturned top flange 14 resting on an apertured platform 15 which is supported by springs 16 on top of the turret 11. Pins 17 on the turret 11 center the springs 16 and slide through holes in the platform 15.

A punch 18 is slidably mounted in the tubular punch guide 13 and has a reduced diameter upstanding shank 19 slidable through a collar 20 resting on the flange 14 and projecting into the top of the tubular guide 13.

A coil spring 21 surrounds the shank 19 and is bottomed on the collar 20 at one end and is compressed by a nut 22 threaded on the other end of the shank 19. The punch 18 is thus spring-suspended in the punch guide 13 from a spring-suspended platform 15 on the turret 11.

A ram 23 engages the nut 22 to activate the punch guide and punch as hereinafter more fully described.

To prevent rotation of the punch 18 in the guide 13 and to prevent rotation of the punch guide 13 in the hole 12, the punch has a laterally extending pin 24. This pin 24 extends through a vertical slot 25 in the punch guide 13 to project into a groove 26 in the hole 12 of the turret 11. The slot 25 opens through the top flange 14 of the guide 13 but has a closed bottom end 27 preventing the punch 18 from dropping through the guide 13.

The punch 18 has a reduced configured active end 28 with a flat bottom end face 29 and a flared top shoulder 30 extending to the full diameter of the punch. This active end 28 of the punch may have any desired configuration and size to form the desired hole in a workpiece W supported on a die 31 of the punch assembly 10. The die 31 has a hole 32 shaped and sized to receive the active end 28 of the punch.

In accordance with this invention, the active end 28 of the punch is slidably guided in a molded plastics member 33 which also serves to strip the punch from the workpiece without damaging the workpiece. This member 33 is integrally bonded in the bottom end of the guide tube 13 with its outer periphery 34 surrounded and supported by the tube which is formed of nonyielding material such as steel.

The guide and stripper member 33 has an inner periphery 35 surrounding the active end of the punch 28 in intimate bearing relationship. This inner periphery 35 has a height greater than the length of the stroke of the punch 18 so that the active end 28 of the punch is always slidably guided by this inner periphery.

The member 33 has a finished smooth end face or edge 36 which may be flush with the bottom end 37 of the punch guide 13 or may project just slightly beyond this bottom end edge 37.

The upper end 38 of the member 33 is flared or beveled from the inner periphery 35 to the outer periphery 34. An annular rib 39 is provided on the member 33 to seat in a groove 40 in the inner periphery of the punch guide 13 to anchor the member against sliding in the punch guide.

Figure 2:
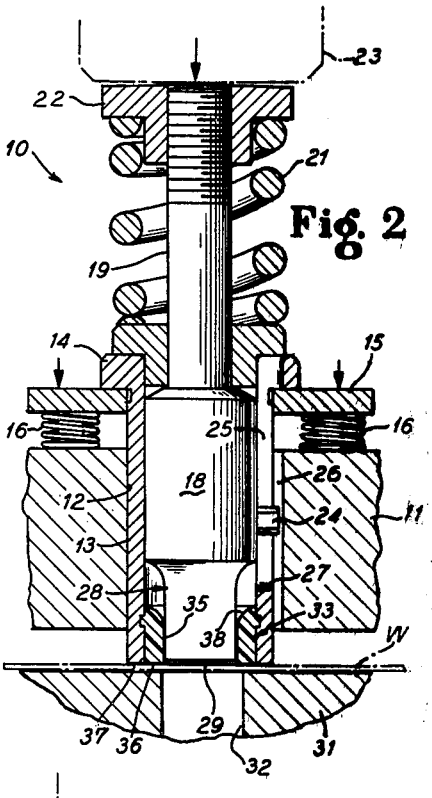
FIG. 2 is a view similar to FIG. 1 but showing the relative positions of the parts just before the punch enters the workpiece.

In operation of the assembly 10, the nut 22 is tightened to compress the spring 21 thereby raising the punch 18 so that its end face 29 is either flush with or retracted into the stripper 33 at the start of the punching operation and before the ram 23 engages the nut 22 as illustrated in FIG. 1. Then, as the ram 23 engages the nut 22, as shown in FIG. 2, the thrust of the ram is applied to the platform 15 through the spring 21 thereby lowering the platform 15 and compressing the springs 16. This lowering of the platform projects the punch guide 13 beyond the turret 11 to seat the end face 36 of the member 33 on the workpiece W around the die hole 32. If this end face 36 is flush with the bottom end edge 37 of the punch guide 13, this end edge 37 will also seat on the workpiece. Thus, as the assembly moves from the starting position of FIG. 1 to the position of FIG. 2, the workpiece W is firmly clamped between the die 31 and the stripper and guide member 33 in the area surrounding the active end 28 of the punch.

Figure 3:
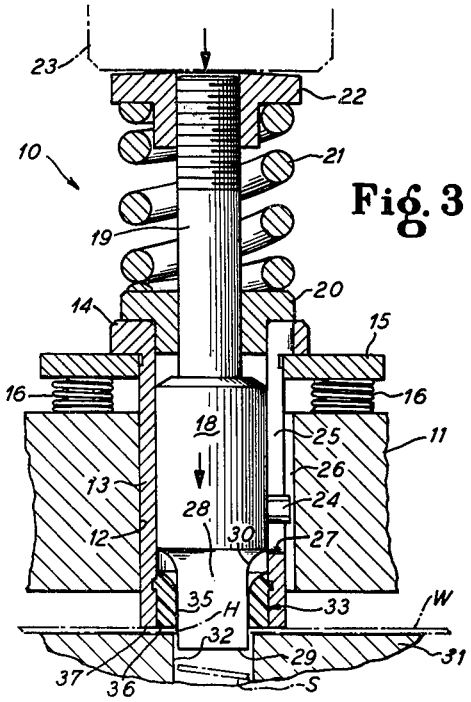
FIG. 3 is a view similar to FIGS. 1 and 2 but showing the relative positions of the parts after the punch has passed through the workpiece.

As the ram 23 descends to the position of FIG. 3, the spring 21 is further compressed to accommodate ejection of the active end 28 of the punch 18 beyond the stripper and guide member 33 and the guide tube 13 with the end 29 of the punch entering the workpiece and cutting a slug S from the workpiece which drops through the die hole 32. This forms a hole H in the workpiece of the exact size and configuration as the leading end 28 of the punch. Since the workpiece W is tightly clamped against the die 31 in the marginal area thereof surrounding the hole H and since the inner periphery 35 of the member 33 is in intimate conforming bearing contact with the punch and thereby extends right up to the periphery of the hole H, very accurate and cleancut punchings are obtained.

After the slug S has been punched out of the hole H, the ram 23 is retracted as shown in FIG. 4 whereupon the spring 21 raises the punch 18 to withdraw its active end 28 within the punch guide 13 and stripper member 33. The spring 21, however, holds the platform 15 at its lower position to continue to press the stripper member 33 against the workpiece so that the active end of the punch 28 will be withdrawn from the punched hole H while the area of the workpiece surrounding the hole is still clamped tightly against the die. This prevents bulging or dimpling of the workpiece as the punch is stripped from the workpiece.

Following the retraction of the active end 28 of the punch into the punch guide and stripper 33, the ram 23 is raised back to the position of FIG. 1 allowing the springs 16 to expand for raising the platform to lift the punch guide 13 back into the turret hole 12 and away from the workpiece.

In accordance with this invention, the guide and stripper member 33 is molded in situ in the punch guide 13 around the active end of the punch 28. Thus, as shown in FIG. 7, the punch 18 is positioned in the guide tube 13 so that the active end 28 projects beyond the end edge 37 of the guide tube but with the flared shoulder 30 of the punch below the groove 40 in the guide tube. This provides an open top molding cavity with an outer wall formed by the inner periphery and groove of the guide tube 13, an inner wall formed by the periphery of the active end of the punch 28, and a bottom wall formed by the shoulder 30. A pour tube or funnel 41 may conveniently be mounted on the guide tube 33 with a skirt 42 embracing the end of the tube and a shoulder 43 bottomed on and covering the end edge 37 of the tube. The inner wall of the guide tube or funnel 41 is of the same diameter as the inner wall of the punch guide 13 and with the skirt 42 centering the tube 41 on this punch guide, the open top of the molding cavity is extended beyond the end 37 of the guide tube 13. The end 28 and the shoulder 30 of the punch 18 together with the interior wall of the funnel tube 41 are coated with a release coating 44 and a viscous hardenable resin is then poured through the tube 41 to fill the mold cavity to a level above the end edge 37 of the guide tube 13. As shown in FIG. 7, the open top mold cavity C is filled with the viscous flowable resin R to a level just above the top end edge 37 of the guide tube 13.

After the resin R filling the mold cavity C has hardened, the tube 41 is removed and the punch 18 retracted in the guide 13. The top end face of the molded resin is either ground flush with the end edge 37 of the guide tube 13 as shown in FIG. 8 or is ground flat at a level just above this end edge as shown in FIG. 9. A grinding wheel illustrated at 45 can conveniently form the flat active end face 36 of the guide and stripper member 33.

Since the guide and stripper 33 is formed in situ in the punch guide and around the active end of the punch, it becomes an integral fixed part of the punch guide tube 13 and conforms exactly with the configuration and size of the active end of the punch. The rigid punch guide enveloping the molded plastics member 33 prevents lateral shifting or deformation of the plastics material but since the preferred material is an elastomer, it can flow under excessive stresses to avoid shattering under high impact loads. The active end face 36 of the plastics member 33 is polished smooth so as not to mar or scratch the workpiece W, and in the embodiment where the end edge 37 of the guide tube 13 also engages the workpiece, this end edge may be polished.

From the above descriptions, it should be understood that this invention provides a punch assembly with a molded plastics material stripper that also acts as a guide for the active end of the punch and is reinforced against lateral displacement by a surrounding rigid punch receiving member.

We claim as our invention:

1. A punch and stripper assembly comprising a punch having a cylindrical body portion and a reduced head end shaped to punch a desired configuration in a workpiece projecting from the body portion, a rigid tubular punch guide slidably supporting the punch having an exit end receiving the punch head therethrough in peripherally spaced relation, a plastics material stripper tightly affixed in the exit end of said guide surrounded by said rigid tubular punch guide and having a punch head molded inner periphery slidably receiving the punch head in full conformity therewith providing lateral support to the punch head, first spring means retracting said guide and stripper away from a workpiece, a ram driving said punch, second spring means compressed by said ram for compressing the said first spring means to press the stripper against a workpiece and said ram having a stroke driving said punch through said workpiece guided and laterally supported by said rigidly supported stripper.

2. The assembly of claim 1 wherein said plastics material stripper has an inner periphery with a height greater than the stroke of the ram to continually engage the punch head throughout its operating stroke.

3. The assembly of claim 1 wherein said stripper has an outer periphery molded in situ in the punch guide and an inner periphery molded in situ around the punch head.

4. The assembly of claim 1 wherein the punch guide has an internal recess and the stripper has a protuberance in said recess securing the stripper against longitudinal movement in the guide.

5. The assembly of claim 1 wherein the guide has an outturned flange at the top end thereof bottomed on a platform supported by said first spring means and the punch has a stem projecting above said flange within said second spring means.

6. The assembly of claim 1 wherein said stripper is an in situ molded urethane body bonded to the punch guide.

7. The assembly of claim 1 wherein the stripper has an end face substantially flush with the exit end of the rigid tubular punch guide.

8. The punch and stripper assembly of claim 1 wherein the rigid tubular punch guide and the stripper are removeable as a unit from the assembly.

* * * * *